US006494767B2

(12) United States Patent
Fisher

(10) Patent No.: US 6,494,767 B2
(45) **Date of Patent: *Dec. 17, 2002**

(54) POLISH AND APPLYING BUFFING MITT, KIT AND METHOD

(76) Inventor: Kurt W. Fisher, 4519 Rutherford Way, Dayton, MD (US) 21036

( * ) Notice: Subject to any disclaimer, the term of this patent is extended or adjusted under 35 U.S.C. 154(b) by 25 days.

This patent is subject to a terminal disclaimer.

(21) Appl. No.: 09/810,459

(22) Filed: Mar. 19, 2001

(65) Prior Publication Data

US 2001/0036803 A1 Nov. 1, 2001

Related U.S. Application Data

(63) Continuation-in-part of application No. 09/421,375, filed on Oct. 20, 1999, now Pat. No. 6,241,580.

(51) Int. Cl.[7] ..... B24B 7/30

(52) U.S. Cl. ..... 451/28; 451/523; 451/533; 15/104.94; 15/227; 401/137; 401/139

(58) Field of Search ..... 15/227, 104.94; 401/137, 139, 196, 6, 7; 451/28, 533

(56) References Cited

U.S. PATENT DOCUMENTS

| | | | | |
|---|---|---|---|---|
| 660,886 A | | 10/1900 | Bryan | |
| 981,192 A | | 1/1911 | Hollingshead | |
| 1,940,728 A | | 12/1933 | O'Connor | |
| 2,351,407 A | | 6/1944 | David | |
| 2,888,133 A | | 5/1959 | Betteridge | |
| 3,056,154 A | | 10/1962 | Neal | |
| 3,217,353 A | | 11/1965 | Karcher | |
| 3,635,567 A | * | 1/1972 | Richardson | 401/132 |
| 3,732,652 A | * | 5/1973 | Furgal et al. | 451/533 |
| 3,777,328 A | * | 12/1973 | Kaplan | 15/104.94 |
| 3,806,260 A | * | 4/1974 | Miller | 401/7 |
| 4,510,640 A | * | 4/1985 | Omori | 15/104 |
| 4,596,481 A | * | 6/1986 | Tanaka | 401/132 |
| 4,788,733 A | | 12/1988 | Lerner | |
| 5,010,617 A | * | 4/1991 | Nelson | 15/227 |
| 5,134,809 A | | 8/1992 | Morton et al. | |
| 5,558,874 A | | 9/1996 | Harber et al. | |
| 5,956,770 A | * | 9/1999 | Dennis | 2/160 |
| 6,016,571 A | * | 1/2000 | Guzman et al. | 2/167 |
| 6,018,837 A | * | 2/2000 | Andreu | 15/118 |
| 6,145,155 A | * | 11/2000 | James et al. | 15/227 |
| 6,241,580 B1 | * | 6/2001 | Fisher | 451/28 |
| 6,250,829 B1 | * | 6/2001 | Brower et al. | 401/7 |

FOREIGN PATENT DOCUMENTS

| | | |
|---|---|---|
| AU | 261274 | 6/1960 |
| GB | 114265 | 3/1918 |
| GB | 327352 | 4/1930 |
| GB | 858087 | 1/1961 |
| JP | 52-20155 | 2/1977 |

* cited by examiner

*Primary Examiner*—George Nguyen
(74) *Attorney, Agent, or Firm*—Duane Morris LLP; L. Lawton Rogers, III; Joseph English

(57) ABSTRACT

A disposable polish applying and buffing mitt comprising a multilayered mitt with a polish impervious layer removably attached to an impervious buffing mitt. A disposable polish applying and buffing mitt comprising a multilayered mitt with a sponge-like layer having an impervious backing removably attached to a buffing mitt. A disposable polish applying and buffing kit comprising a multilayered mitt with a first layer of polish impervious material removably secured to a second layer of polish impervious material forming a compartment therebetween which can hold a polish. The first layer of polish impervious material is removed from the second layer of polish impervious material to expose the polish for application. After the polish is applied to the object, the second layer of polish impervious material is removed to expose the buffing mitt.

20 Claims, 3 Drawing Sheets

POLISH AND APPLYING BUFFING MITT, KIT AND METHOD

RELATED APPLICATIONS

This application is a continuation-in-part of a U.S. patent application Ser. No. 09/421,375 entitled "POLISH AND APPLYING BUFFING MITT, KIT AND METHOD", filed on Oct. 20, 1999 now U.S. Pat. No. 6,241,580.

BACKGROUND

This application is directed to a disposable polish applying and buffing mitt, a disposable polish applying and buffing kit, and methods of using the mitt and kit.

The consumer market for quick disposable products that provide high quality polishing results is growing. The demand is great for a product that provides a high quality polish which protects the user from the polish and which lends itself to quick and easy clean-up in a variety of environments such as shining shoes, waxing an automobile, applying plastic protectants to an automobile, polishing silverware, staining furniture, cleaning furniture, oven cleaning, medical equipment cleanup, washing windows, cleaning and conditioning leather and even for wiping and clean-up of babies.

This application claims the benefit of U.S. application Ser. No. 09/421,375 filed Oct. 20,1999, POLISH APPLYING AND BUFFING MITT, KIT AND METHOD which is herein incorporated by reference, which disclosed a pervious material buffing mitt and an impervious material layer attached to the buffing mitt. One embodiment of the prior polish applying and buffing mitt or kit may include an impervious inner layer within the buffing mitt. One advantage of having an inner impervious layer within the buffing mitt is that another layer of protection is provided to protect the user from coming into contact with the polish.

The addition of the cleaning layer to one embodiment of the polish applying and buffing mitt or kit allows the user to first clean the object to be polished. The cleaning layer may comprise a layer of sponge-like material or absorbent material attached to the layer of material impervious to polish on the buffing mitt. The cleaning layer may also be used to apply the polish. Since the cleaning layer is removably attached to an impervious layer on the buffing mitt, the cleaning fluid or polish should not penetrate the buffing mitt and contact the user's hand during the cleaning or polishing step.

A sponge-like layer or absorbent layer having an impervious backing may also be removably attached to an embodiment of the prior buffing mitt. The sponge-like layer may be used to apply the polish. One advantage of using the sponge-like material layer or absorbent layer is that when the user applies pressure to the layer from within the mitt, the polish absorbed in the layer may be released onto the object in a specific location, which allows the user to apply polish to hard to access locations on the object which may not be reached for example by a spray applicator, e.g., an automobile dashboard. The layer of sponge-like material may also be directly sprayed with the polish. The sponge-like layer having an impervious backing may be removed to expose the buffing mitt after the polish has been applied. The buffing mitt may also include an inner impervious layer to further protect the user from contacting the polish.

Polishing mitts are well known. Typically, they utilize the same material for applying the polish and buffing and, require reversing of the mitt on the hand between the application of the polish and buffing of the polish. Often this allows polish to be absorbed into the polish application layer during the polishing step resulting in the need for a great quantity of polish and staining the hand. In addition, the polish application layer surface is exposed during buffing and often results in soiling of the hands or clothes of the person doing the polishing. Many also require cleanup after use.

Accordingly it is the object of the present invention to provide novel devices and methods which obviate many of the deficiencies of known disposable polishers.

It is another object of the present invention to provide a novel disposable polish applying and buffing mitt and a polish applying and buffing kit where the buffing mitt is impervious to the polish to be applied for use in applying a polish to an object and buffing the polish into the object.

It is still another object of the present invention to provide a novel disposable polish applying and buffing kit that contains a polish.

It is yet another object of the present invention to provide a novel disposable polish applying and buffing mitt and kit that includes a layer of sponge-like material having an impervious backing that may be used to apply the polish to the object.

It is a further object of the present invention to provide a novel disposable polish applying and buffing mitt and kit that can be used for two different applications.

It is still a further object of the present invention to provide a polish applying and buffing mitt and a novel method of applying polish to an object using the mitt.

It is yet a further object of the present invention to provide a polish applying and buffing kit and a novel method of applying polish to an object using the kit.

These and many other objects and advantages of the present invention will be readily apparent to one skilled in the art to which the invention pertains from a perusal of the claims, the appended drawings, and the following detailed description of the preferred embodiments.

DESCRIPTION OF THE PREFERRED EMBODIMENTS

Figure 1:
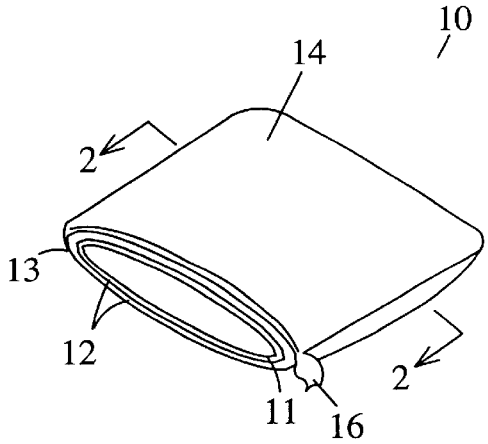
FIG. 1 is a pictorial view of a hand sized embodiment of the impervious buffing mitt of the present invention including a polish impervious layer on one side.
Figure 2:
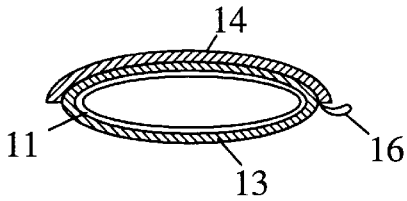
FIG. 2 is a section taken through lines 2—2 of FIG. 1.

With reference to FIG. 1 and FIG. 2, one embodiment of the disposable polish applying and buffing mitt 10 of the present invention is dimensioned and configured to receive a human hand. The polish applying and buffing mitt can also be dimensioned and configured to receive one, two, three, or four fingers; or have a thumb sleeve; or be gloved shaped. The configuration and dimension of the buffing mitt 10 is desirably selected based on the object to be polished. For example, to apply a car wax a large mitt would be preferred, while to polish smaller objects like silverware, a one-finger or two-finger shaped mitt would be preferred.

The polish applying and buffing mitt 10 is a multilayered mitt that comprises buffing mitt 12 being made of polish pervious material suitable for buffing an object once the polish has been applied thereto. The buffing mitt 12 may have an inner layer 11 of impervious material and an outer layer 13 of material pervious to the polish to be applied to the object suitable for buffing. The inner layer 11 of the buffing mitt 12 may be made of impervious material and may comprise any suitable plastic or impervious material, e.g., polymer film, polypropylene, polyethylene, polyvinyl chloride, polyvinylidene chloride, polyamide or cellophane. The outer layer 13 of the buffing mitt 12 may made of material pervious to the polish to be applied to the object and may be any material suitable for buffing the object to be polished, e.g., cotton, cotton flannel, fabric, terry cloth, chamois, paper product or non-woven, flocked and bonded fabrics made of plastic. The inner and outer layers 11, 13 of the buffing mitt 12 may be attached by any suitable means e.g., heat seal, pressure sensitive seal, adhesive seal or velcro.

The mitt 10 further comprises a layer of material 14 impervious to the polish that is removably secured to at least one side of the buffing mitt 12 on the polish applying and buffing mitt 10. The layer 14 may be any material suitable for applying polish to the object, e.g., plastic polymer film, polypropylene, polyethylene, polyvinyl chloride, polyvinylidene chloride, polyamide or cellophane. The size of the polish impervious layer on the buffing mitt is dependent on the object to be polished. For example, to apply wax to a car the polish impervious layer may cover at least one side of the mitt, while for shining a shoe the polish impervious layer may cover approximately one third of the closed end of the mitt one side thereof.

The polish impervious layer 14 is removably secured to the buffing mitt 12 such that the layer 14 can be removed from the buffing mitt 12 once the polish has been applied to the object. In the present embodiment a tab 16, attached to the layer 14, is pulled to remove the layer 14 from the buffing mitt 12. The layers of the mitt and kit can be removably secured to each other by any suitable means, e.g., the layer is removably secured to the buffing mitt by plastic perforation that can be released by pulling a tab attached to the layer; a tab attached to the layer that comprises a plastic sealing ring can be pulled to remove the layer from the buffing mitt; or a tab attached to the layer can be pulled to remove the layer from the buffing mitt by breaking the seal between the layer and the buffing mitt. The seal between the layer and the buffing mitt may be any conventional seal e.g., heat seal, pressure sensitive seal, velcro or an adhesive seal.

The mitt 10 is dimensioned and configured to receive a human hand into the open pocket of the buffing mitt and may be dipped into a polish so that the polish impervious layer 14 receives the polish and the layer 14 is used to apply the polish to the object by the hand within the buffing mitt 10. After the proper amount of polish has been applied to the object the layer 14 can be removed exposing the buffing mitt 12. The layer 14 can be removed from the buffing mitt 12 by pulling the tab 16 attached to the layer 14. The buffing mitt 12 can then be used to buff the polish into the object by the hand within the buffing mitt 12. When the buffing is completed the buffing mitt 12 can be removed from the hand for disposal.

In another embodiment of the disposable polish applying and buffing mitt, separate polish impervious layers may be removably secured on opposite sides of the buffing mitt to the buffing mitt such that the buffing mitt can be used on two separate occasions for application of polish.

Figure 3:
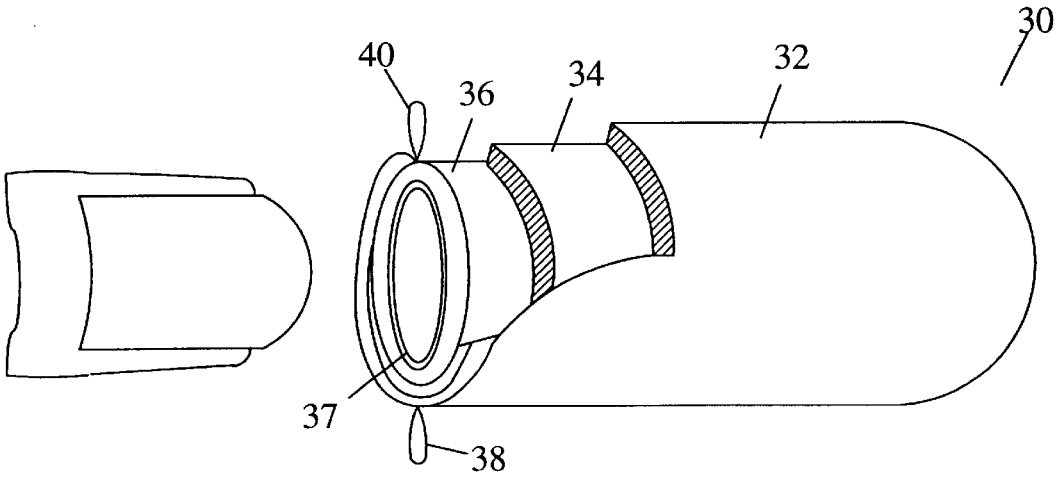
FIG. 3 is a pictorial view of a finger shaped embodiment of the mitt of the present invention in a partial section illustrating cleaning, polish applying, and buffing layers.

With reference to FIG. 3, the polish applying and buffing mitt 30 is dimensioned and configured to receive a finger and to include a layer of cleaning material or a layer of sponge-like material 32 removably secured to the polish impervious layer 34. The cleaning layer 32 may be comprised of any material suitable for cleaning the object or applying polish to the object, e.g., sponge, sponge-like, cotton, cotton flannel, fabric, terry cloth, paper product, or absorbent material. The sponge-like material layer 32 may be used to clean the object prior to the application of a polish by brushing off or removing dirt from the object or the layer 32 may be used with water or a cleaning liquid to clean the object.

Once the cleaning is completed pulling the tab 38 attached to the sponge-like layer 32 removes the sponge-like layer 32 from the polish impervious layer 34. The polish impervious layer 34 may then be used to apply the polish. In some instances the sponge-like material layer 32 may be used to apply the polish to the object and then is removed with or without the polish impervious layer 34.

The polish impervious layer 34 is removably secured to the buffing mitt 36 by a tab 40 which is attached to the layer 34 thereof such that pulling the tab 40 removes the polish impervious layer 34 from said buffing mitt 36 as described in connection with the mitt of FIG. 1.

A finger can be inserted into the open end of the mitt 30 and the sponge-like material layer 32 may be used to clean the object. When the object has been cleaned, the sponge-like material layer 32 can be removed by pulling the tab 38 attached to the sponge-like layer 32 which removes the sponge-like layer 32 from the polish impervious layer 34. The layer 34 may then be dipped into a polish so that the layer 34 is used to apply the polish to the object by the finger within the buffing mitt 36. The buffing mitt 36 may also include an inner layer 37 of impervious material. After the proper amount of polish has been applied to the object, the layer 34 can be removed from the buffing mitt 36 by pulling on the tab 40 attached to layer 34 to remove the layer 34 and expose the buffing mitt 36. The mitt 36 can then be used to buff the polish into the object by the finger within the buffing mitt 36 without the polish contacting the finger of the user. After the buffing of the object is completed, the finger shaped buffing mitt 36 can be removed for disposal.

Figure 4:
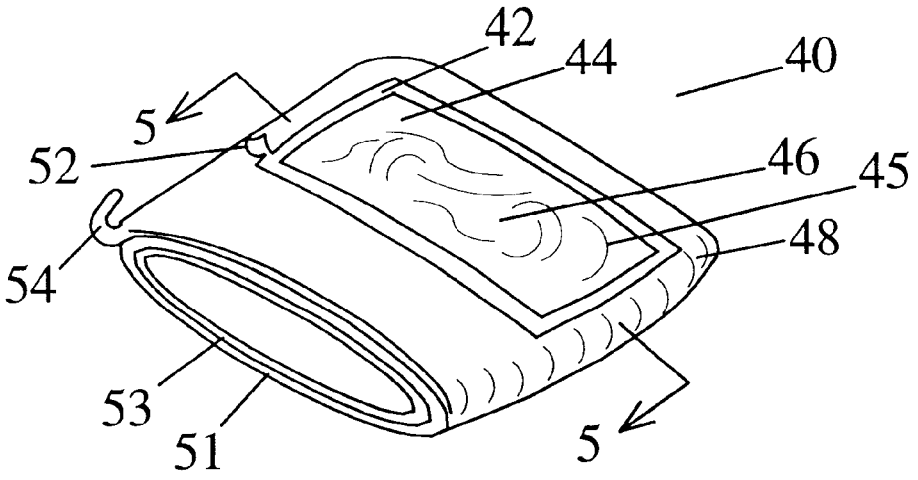
FIG. 4 is a pictorial view of a first embodiment of a hand sized kit illustrating a polish containing compartment adjacent the distal end thereof.
Figure 5:
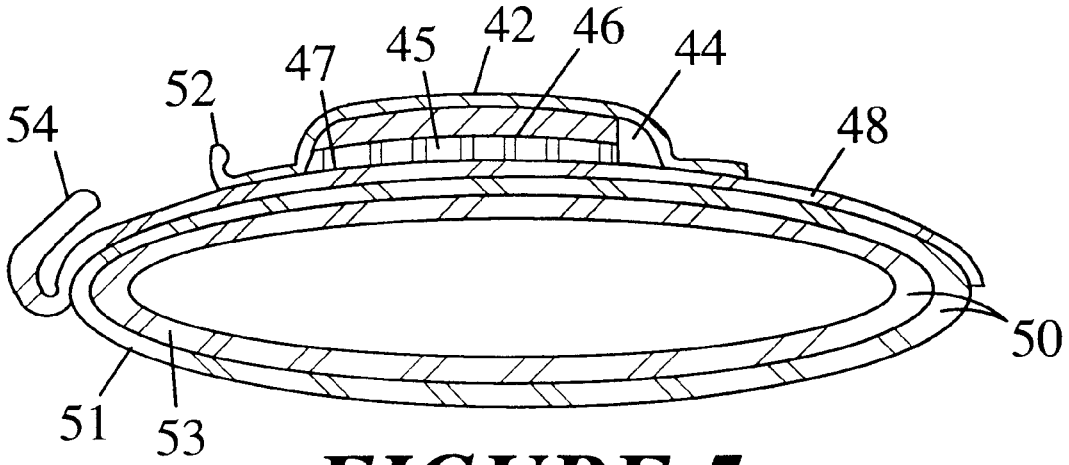
FIG. 5 is a section taken through lines 5—5 of FIG. 4.

With reference now to FIG. 4 and FIG. 5, a disposable polish applying and buffing kit 40 is dimensioned and configured to receive a human hand which is inserted into the open pocket of the kit 40. The kit 40 has a first layer of material 42 impervious to the polish to be applied to the object. The first layer 42 is removably secured to a second layer of material 48 impervious to the polish and forms a sealed compartment 44 between said first and second layers. The sealed compartment 44 contains a quantity of polish 46 sufficient to cover the object to be polished. The polish can be any material suitable for polishing an object, e.g., shoe polish, car wax, furniture wax, silver polish, plastic and vinyl protectants, leather cleaner, window cleaner and other general types of cleaners (e.g., solvents, degreasers, disinfectants, and soaps).

The sealed compartment may also include a layer of sponge-like material 45 removably attached to the second layer of material impervious to the polish 48. The sponge-like layer 45 may be saturated with the polish (e.g., plastic protectants for automobiles) or the polish may be placed on top of the sponge-like layer 45 (e.g., shoe polish). The layer of sponge-like material 45 may be removed by pulling on the tab 47 attached thereto.

The first layer 42 is removably secured to the second layer 48 and can be removed from the second layer to expose the polish 46 by pulling the tab 52 attached to the first layer 42. The second layer 48 is removably secured to the buffing mitt 50 and can be removed from the buffing mitt 50 by pulling the tab 46 attached to the second layer 48.

The polish applying and buffing kit 40 can be used by placing a hand inside the open end of the kit 40. The first layer 42 is removed from the second layer 48 by pulling tab 52 which removes the first layer 42 and exposes the polish 46. The layer 48 and sponge-like layer 45 may then used to apply the polish 46 to the object by the hand within the buffing mitt 50. When the proper amount of polish 46 has been applied to the object to be polished the sponge-like layer 45 may be removed by pulling tab 47 to release the sponge-like layer 45 from the second layer 48. The second layer 48 may then be used to further apply the polish. The second layer 48 may then be removed from the buffing mitt 50 by pulling tab 54 attached to the second layer 48. Pulling tab 54 removes the second layer 48 from the kit 40 and exposes the outer layer 51 of material pervious to polish of the buffing mitt 50. The buffing mitt 50 can then be used to buff the polish 46 into the object by the hand within the buffing mitt 50. The buffing mitt 50 may include an inner layer of impervious material 53 which protects the user from being exposed to the polish. After buffing of the object is completed, the buffing mitt 50 can be removed for disposal.

In another embodiment of the polish applying and buffing kit, a layer of cleaning material can be removably secured to the first layer of polish impervious material so that the layer of cleaning material can be used to clean the object to be polished prior to applying a polish. The cleaning layer is removably secured to the first layer and is removed from the kit after the object has been cleaned by pulling a tab attached to the cleaning layer.

In yet another embodiment, the disposable polish applying and buffing kit has separate first layers, polish, and second layers on opposite sides of the buffing kit to allow for the kit to be used twice. The first and second layers are removably secured such that they are separately removed from one side of the kit.

In a further embodiment, the disposable polish applying and buffing kit is comprises a glove-shaped buffing mitt that is maintained in the shape of a mitt by the second polish impervious layer. When the second layer is removed from the buffing mitt, the buffing mitt can be formed into a glove shape by moving the fingers with the glove shaped buffing mitt. This embodiment is effective for polishing objects that have smaller pockets into which the polish needs to be buffed such as finely crafted furniture with embossed ornamentations on the surface thereof.

Figure 6:
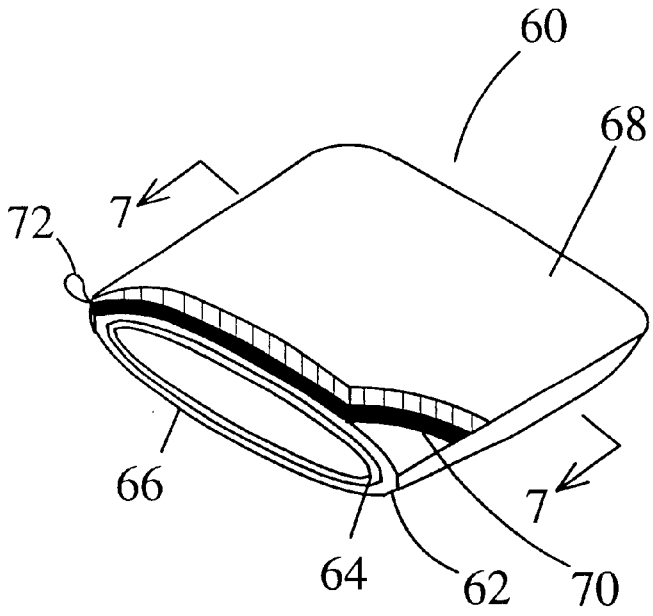
FIG. 6 is a pictorial view of a hand sized embodiment of the buffing mitt of the present invention including a layer of sponge-like material having an impervious backing attached to one side of the buffing mitt.
Figure 7:
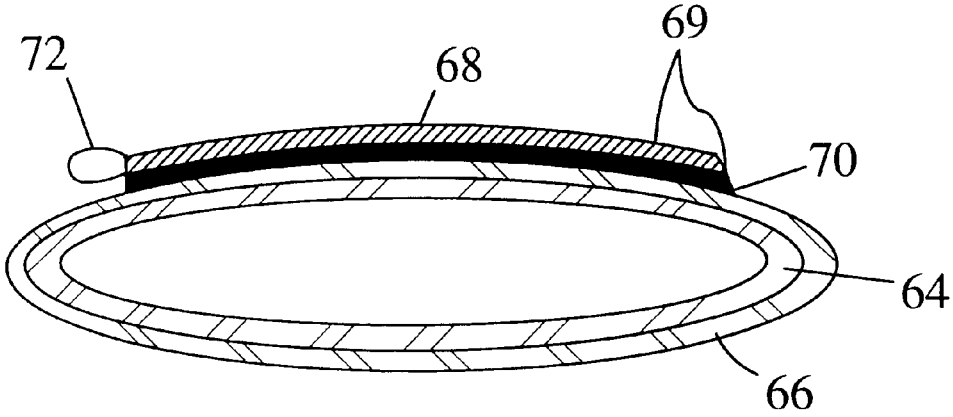
FIG. 7 is a section taken through lines 7—7 of FIG. 6.

With reference to FIGS. 6 and 7, the polish applying and buffing mitt 60 may be a multilayered mitt that comprises a buffing mitt 62 suitable for buffing an object with a polish applied thereto. The buffing mitt 62 may include an impervious inner layer 64 and an outer layer 66 of material suitable for buffing. A layer of sponge-like material having an impervious backing 69 may be removably attached to the buffing mitt 62. The layer of sponge-like material 68 may be comprised of any material suitable for applying polish to the object, e.g., sponge, sponge-like, cotton, cotton flannel, fabric, terry cloth, paper product or absorbent material. The impervious backing 70 may be comprised of similar materials used for the layers of material impervious to polish 14, 48 described in the embodiments above.

The layer of sponge-like material having an impervious backing 69 is removably secured to the buffing mitt 62 such that the layer having a backing 69 may be removed from the buffing mitt 62 once the polish has been applied to the object. In the present embodiment a tab 72, attached to the layer having a backing 69, may be pulled to remove the layer having a backing 69 from the buffing mitt 62. The layer having a backing 69 of the mitt 62 and kit may be removably secured to each other by any suitable means, as described for other embodiments above. The seal between the backing 70 and the buffing mitt 62 may be any conventional seal e.g., heat seal, pressure sensitive seal, velcro or an adhesive seal. The layer having a backing 69 may be sized according to the object to be polished, e.g., one half of the mitt, one third of the mitt or the entire mitt. In some applications, plural individual layers having a backing 69 may stacked one upon the other if necessary where the backing 70 of one layer having a backing 69 is removably secured to the layer of sponge-like material 68 of another layer having a backing 69 beneath. The layers having a backing 69 may be removed after the separate applications of polish have been applied.

The polish applying and buffing mitt 60 is especially useful in applying liquid polishes such as plastic protectants for automobiles or window washing fluids because the polish may be sprayed directly on the layer of sponge-like material 68. When the user applies pressure from within the mitt to the object the polish within the sponge-like material layer 68 may be released from the layer 68 and directed to specific locations on the object. This feature is especially valuable when polishing an object where spraying cannot be directed to a precise location on an object, e.g., certain spots on a car dash board. The impervious backing 70 prevents the polish from penetrating the buffing mitt 62 during application of the polish.

The buffing mitt 62 may be provided with individually packaged layers having a backing 69 that allow the user to reuse the buffing mitt 62 by attaching a new layer having a backing 69 to the mitt 62. The buffing mitt 62 may also include separate layers having a backing 69 positioned on each side of the mitt 62 to allow for two uses of the mitt 62.

The mitt 60 is dimensioned and configured to receive a human hand into the open pocket of the buffing mitt 62 and after the layer of sponge-like material 68 receives the polish, the layer having a backing 69 is used to apply the polish to the object by the hand within the buffing mitt 60. After the proper amount of polish has been applied to the object, the layer having a backing 69 may be removed exposing the buffing mitt 62. The layer having a backing 69 may be removed from the buffing mitt 62 by pulling the tab 72 attached to the layer having a backing 69. The buffing mitt 62 may then be used to buff the polish into the object by the hand within the buffing mitt 62. When the buffing is completed the buffing mitt 62 can be removed from the hand for disposal or a new layer having a backing 69 may be removably attached to the mitt 62 to allow re-use of the mitt.

The layer having a backing 69 and the mitt 62 may also be designed to function as a kit. An outer layer of impervious material may be sealed over the impervious backing 70 to thereby form a compartment including the layer of sponge-like material 68. A polish may also be included within the compartment. The outer impervious layer may be removed by pulling on a tab attached thereto to expose the layer of sponge-like material 68 so the polish may be applied to the object.

ADVANTAGES AND SCOPE OF THE INVENTION

The advantages of the present inventions are numerous. The polish applying and buffing mitt and the polish applying and buffing kit can be designed to optimize the polishing of an object by selecting a buffing material and polish impervious layer for the buffing mitt based on the object to be polished and the polish to be used. The user may be protected from coming into contact with the polish when an impervious buffing mitt is provided. The mitt may be designed to include numerous alternate sponge-like layers and impervious layers so that one mitt may be used to apply different or multiple applications of a polish. In addition, in some cases depending on the polish applied, the buffing mitt may also be re-used when an impervious layer or sponge-like layer having an impervious backing is adhered to the used buffing mitt.

The use of a polish impervious material layer in the design allows for less polish required for the polish applying step, even when the cleaning layer or sponge-like layer is attached, since the polish will not penetrate the polish impervious material layer to during application. Since less polish is required the mitt and polish may be sold in combination resulting in a reduction in manufacturing costs without a decrease in polishing results.

The polish applying and buffing mitt and the polish applying and buffing kit can be dimensioned and configured to ensure the object is polished correctly. Basing the configuration of the mitt and kit on the object to be polished will ensure a higher quality polish. The mitt and kit can be shaped to receive a hand, have a thumb sleeve in the mitt, receive one to four fingers, be round or square. However the possible configurations of the mitt and kit are not based on size and shape alone.

Additional features can be added to the mitt and kit to optimize the polishing of an object. An outer cleaning layer comprising a sponge-like layer or absorbent layer may be added to the mitt or kit. The cleaning layer may include an impervious layer backing or may be removably attached to an impervious layer to prevent the cleaning fluid from contacting the mitt or kit. The outer cleaning layer may used to apply water or a cleaning fluid to an object before the polishing commences.

Instead of cleaning the object, the cleaning layer may be used to apply the polish directly to the object. The sponge-like layer also enables the user to apply pressure from within the mitt to release polish from the sponge-like layer during application of the polish to the object. In addition, the polish may be sprayed directly on the sponge-like layer to saturate the sponge-like layer to enhance the application of the polish to the polish. The sponge-like layer may be removable separately or removable together with the polish impervious layer.

Some uses of the buffing mitt or kit may utilize a layer of absorbent material instead of a layer of sponge-like material. The layer of absorbent material may be used to soak up spills and may be sized accordingly. The layer of absorbent material may have an impervious backing and be attached to the mitt or may be removably attached to the layer of material impervious to polish on the buffing mitt. The use of the absorbent layer to clean up spills could be done quickly and efficiently. The user may be further protected from the spill by including a layer of impervious material within the buffing mitt.

The mitt may be designed so that the absorbent material layer and/or the polish impervious layer may be removed and then reattached back to the mitt. This feature may be used, for example, when applying automotive protectants where it is necessary to buff the protectant before the protectant dries in place. The absorbent material layer and/or the polish impervious layer may also be designed to be positioned from the face of the mitt to the back of the mitt by flipping the layer to the back hand of the mitt if the absorbent layer and or the polish impervious layer is only attached to one end of the mitt, e.g., side or top. or velcro may be placed on the face and back of the mitt so the layers may be switched from front to back as needed.

An additional buffing strap can be included inside the mitt or kit. In some cases two buffing layers removably secured to each other will be required to properly polish the object. The two buffing layers can even be made of different materials resulting in a higher quality polish than just one buffing layer. The same holds true for the polish impervious layers where in some cases two layers may be needed to apply the polish to the object with a first specific layer of polish impervious material and a second polish impervious layer to further aid the appliction of the polish prior to buffing.

The polish applying and buffing mitt is suitable for any operation that benefits from the application of a polish to an object by a polish impervious layer and buffing of the polish into the object by a pervious layer, including wiping, washing, cleaning or dusting of an object. Such operations include but are not limited to cleaning and polishing mechanical equipment. The cleaning layer may be used to remove substances such as excess grease from mechanical equipment. After cleaning, the cleaning layer may be removed and the polish impervious layer may be used to apply degreaser to the equipment. After application of the degreaser, the polish impervious layer may be removed and the pervious material of the buffing mitt may then be used to buff the degreaser into the equipment. When buffing is completed the buffing mitt can be removed for disposal. The result is clean equipment without the soiling of the hands.

Further by way of example, the polish applying and buffing mitt may be useful in the cleanup of medical equipment if utilized with hospital gloves. The cleaning layer may be used to wipe the medical wastes from medical equipment, such as an operating table. After cleaning, the cleaning layer may be removed and the polish impervious layer may further wipe any excess medical wastes from the table if required, and then may be used to apply a disinfectant or cleaner to the medical equipment. After application of the disinfectant or cleaner the polish impervious layer may be removed and the buffing mitt may then be used to buff the disinfectant or cleaner into the equipment. When the buffing is completed the buffing mitt may be removed for disposal. The use of medical gloves in conjunction with the polish applying and buffing mitt would protect the user from the medical wastes.

The polish applying and buffing mitt and the polish applying and buffing kit allow for the consumer to polish an object without requiring cleanup. There is no need to reverse orient the mitt on the consumer's hand while polishing an object which could result in soiling of the hand or fingers. The removable layers are designed so that the consumer will never come in contact with the polish. Often the polish impervious layer is removed after the polish is applied so that there is not an exposed layer of polish during buffing. This cleanup free feature lends itself to travelers or to consumers in a hurry to complete the polishing of an object.

While preferred embodiments of the present invention have been described, it is to be understood that the embodiments described are illustrative only and the scope of the invention is to be defined solely by the appended claims when accorded a full range of equivalence, many variations and modifications naturally occurring to those of skill in the art from a perusal hereof.

What is claimed is:

1. A disposable polish applying and buffing mitt comprising:

a buffing mitt dimensioned and configured to receive at least a portion of a human hand, said buffing mitt being made of polish pervious material suitable for buffing an object once the polish has been applied thereto;

a layer of polish impervious material removably secured to said buffing mitt for the application of the polish to the object, said impervious layer being manually removable from said buffing mitt after the mitt has been used to apply polish to the object so that the mitt can be used for buffing.

2. The polish applying and buffing mitt of claim 1 wherein said buffing mitt includes an inner layer of impervious material to protect the human hand from polish penetrating said buffing layer.

3. The polish applying and buffing mitt of claim 1 further comprising a layer of sponge-like material removably attached to said impervious layer so that an object may be cleaned with said sponge-like material layer, receive the application of polish once the sponge-like layer is removed, and polished with the buffing layer once said impervious layer is removed.

4. The polish applying and buffing mitt of claim 1 further comprising a layer of sponge-like material securely attached to said impervious layer so that the polish may be applied to an object with said sponge-like material layer, and polished with the buffing layer once said sponge-like material layer and said impervious layer are simultaneously removed.

5. The polish applying and buffing mitt of claim 1 further comprising:

a second layer of material impervious to the polish to be applied to the object;

said second layer being removably secured to said impervious layer in a position with respect to said second layer to form a sealed compartment therebetween; and, a quantity of polish sufficient to cover the surface of the object to be polished, said polish found contained within said compartment between said impervious layer and said second layer;

said second layer being manually removable from said impervious layer to expose said polish for application to the object.

6. The polish and applying buffing mitt of claim 5 further comprising a sponge-like layer within said compartment securely attached to said impervious layer so that the polish can be applied to an object using said sponge-like layer and whereby said sponge-like layer and said impervious layer are removed to expose said buffing mitt.

7. A disposable polish applying and buffing mitt comprising:

a buffing mitt dimensioned and configured to receive at least a portion of a human hand, said buffing mitt being made of an outer layer of polish pervious material suitable for buffing an object once the polish has been applied thereto and an inner layer of impervious material to protect the human hand from polish penetrating said buffing layer;

a layer of polish impervious material removably secured to said buffing mitt for the application of the polish to the object, said impervious layer being manually removable from said buffing mitt after the mitt has been used to apply polish to the object so that the mitt can be used for buffing.

8. A disposable polish applying and buffing mitt comprising:

a buffing mitt dimensioned and configured to receive at least a portion of a human hand, said buffing mitt being made of polish pervious material suitable for buffing an object once the polish has been applied thereto;

a layer of polish impervious material removably secured to said buffing mitt on at least one side thereof for the application of the polish to the object, said impervious layer being manually removable from said buffing mitt after the mitt has been used to apply polish to the object so that the mitt can be used for buffing; and, a layer of sponge-like material removably attached to said impervious layer so that an object may be cleaned with said sponge-like material layer, receive the application of polish once the sponge-like layer is removed, and polished with the buffing layer once said impervious layer is removed.

9. The polish applying and buffing mitt of claim 8 wherein said buffing mitt includes an inner layer of impervious material to protect the human hand from polish penetrating said buffing layer.

10. The polish applying and buffing mitt of claim 8 wherein said sponge-like layer is used to apply the polish.

11. A disposable polish applying and buffing mitt comprising:

a buffing mitt dimensioned and configured to receive at least a portion of a human hand, said buffing mitt being made of polish pervious material suitable for buffing an object once the polish has been applied thereto;

a layer of sponge-like material having an impervious backing removably secured to said buffing mitt for the application of the polish to the object, said sponge-like layer having an impervious backing being manually removable from said buffing mitt after the mitt has been used to apply polish to the object so that the mitt can be used for buffing.

12. The polish applying and buffing mitt of claim 11 wherein said buffing mitt includes an inner layer of impervious material to protect the human hand from polish penetrating said buffing layer.

13. A method of polishing an object comprising the steps of:

(a) providing a multilayered mitt suitable to receive at least a portion of the human hand;

(b) applying a polish to an object using the layer of polish impervious material of the mitt;

(c) removing the layer of polish impervious material from the mitt to expose an impervious buffing mitt;

(d) buffing the object without the polish coming in contact with the human hand of the user; and, (e) removing the mitt from the hand for disposition.

14. A method of cleaning and polishing an object comprising the steps of:

(a) providing a multilayered mitt with a thumb sleeve suitable to receive the human hand;

(b) cleaning the object to be polished using the layer of sponge-like material of the buffing mitt;

(c) removing the layer of sponge-like material to expose a polish impervious layer;

(d) applying the polish to the object using the polish impervious material of the mitt;

(e) removing the impervious layer from the mitt to expose the buffing mitt;

(f) buffing the polish applied to the object with the buffing mitt; and, (g) removing the mitt from the hand for disposition.

15. The method of claim 14 wherein the buffing mitt is impervious.

16. The method of claim 14 wherein the cleaning layer is used to apply the polish to the object.

17. A method of polishing an object comprising the steps of:

(a) providing a multilayered mitt suitable to receive the human hand;

(b) applying a polish to an object using a layer of sponge-like material having an impervious backing;

(c) removing the layer of sponge-like material having an impervious backing to expose the buffing mitt;

(d) buffing the polish applied to the object with the buffing mitt; and, (e) removing the mitt from the hand for disposition.

18. The method of claim 17 wherein the buffing mitt is impervious.

19. The method of claim 17 wherein the sponge-like layer is sprayed directly with the polish.

20. The method of claim 17 wherein a second impervious layer is removably secured to the sponge-like layer having an impervious backing to form a compartment therebetween containing the polish to be applied to the object.

* * * * *